United States Patent [19]

Dias dos Santos

[11] Patent Number: 4,660,474

[45] Date of Patent: Apr. 28, 1987

[54] PERCUSSION OR IMPACT WAVE CONDUCTOR UNIT

[75] Inventor: Danilo A. Dias dos Santos, Curitiba, Brazil

[73] Assignee: Britanite Industrias Quimicas Ltda., Parana, Brazil

[21] Appl. No.: 690,879

[22] Filed: Jan. 14, 1985

[30] Foreign Application Priority Data

Jan. 13, 1984 [BR] Brazil ..... 8400206

[51] Int. Cl.[4] ..... C06C 5/04

[52] U.S. Cl. ..... 102/275.8; 102/275.5; 102/275.1; 149/3; 149/15

[58] Field of Search ..... 102/275.1, 275.8, 275.5; 149/3, 15

[56] References Cited

U.S. PATENT DOCUMENTS

| | | | |
|---|---|---|---|
| 3,590,739 | 7/1971 | Persson | 102/275.8 |
| 3,730,096 | 5/1973 | Prior | 102/275.8 |
| 4,080,902 | 3/1978 | Goddard et al. | 102/275.8 |
| 4,290,366 | 9/1981 | Janoski | 102/202.3 |
| 4,328,753 | 5/1982 | Kristensen et al. | 102/275.8 |
| 4,493,261 | 1/1985 | Simon et al. | 102/275.8 |

*Primary Examiner*—Stephen J. Lechert, Jr.

*Attorney, Agent, or Firm*—Kimmel, Crowell & Weaver

[57] ABSTRACT

A device for application in the art of blasting, by the use of nonelectric devices, and the new concept that employs pyrotechnic mixtures and combinations thereof which are distributed in granular form throughout the inside of a supporting tube. The pyrotechnic mixture applied to the supporting tube having been subjected to a suitable mixing process to ensure cohesive properties so that the mixture will adhere in the proper manner to the inside surface of the supporting tube, and will allow for great flexibility in the density of the surface charge, in addition to allowing for the use of a vast range of chemical substances, as well as the secondary use of these devices as retarder units.

1 Claim, No Drawings

PERCUSSION OR IMPACT WAVE CONDUCTOR UNIT

This invention relates to a percussion or impact wave conductor unit and to the art of blasting explosives. More particularly, it relates to the art of blasting by the use of nonelectric devices, in which pyrotechnic mixtures and combinations thereof are employed. It now provides the art of using these devices with a new and irrefutable technological breakthrough which enables them to be cheaper, widens their range of applicability and makes it feasible for them to be used within an ample range of available choices of burning speeds and percussion or impact wave conduction, which had heretofore never been managed.

Within all the known patents, which deal with low-energy percussion or impact wave conductor tubes, there is no doubt whatsoever that applicant's Brazilian Pat. No. 8104552 was the one to provide the greatest advance in the art of blasting explosives by the use of nonelectric devices.

The remaining available patents and/or usages exhibit a number of disadvantages as compared to the present invention, as will be seen ahead. One of the safest nonelectric devices currently uses aluminothermic reactions to sustain and conduct high-velocity percussion or impact waves. This is only possible by the nongeneration of gases in the interior of the tube or duct, which is no doubt very limiting, if the ample range of chemical substances is taken into account.

Another negative aspect is that very restricted amounts of aluminothermic materials are deposited in the interior of the tube, in addition to the fact that the manufacturer of the percussion or impact wave sustaining and conducting device makes use of ducts with walls of less than one millimeter in thickness, as may be inferred by logical deduction.

The present invention, however, simply and altogether overcomes all the cited disadvantages, since it uses as a support for the material to be deposited any duct which is capable of allowing the adhesion of the substances used, with no further concern as to the relationship between the inner and outer diameter, nor to restrictions as to the substances being used. Nevertheless, for matters of safety, only pyrotechnic mixtures are used, as these exhibit far greater reliability in handling and in the mixing processes by which thorough homogeneity of the product is obtained, with no loss of the cohesive properties. The invention uses chemical substances commonly employed in pyrotechnic mixtures and other, not so commonly used, substances, to aid in the mixing and/or reaction process, in order to cause the final mixture to be best suited to the purposes for which it is intended, and to provide a very wide range of usable substances.

However, all the characteristically pyrotechnic mixtures generate large amounts of heat in their combustion reaction, a fact which is used in the present invention to enable a percussion or impact wave to be propagated and maintained within the duct. Gas-generating substances are used to reinforce the percussion wave being propagated within the duct. This percussion wave can be generated by any means which produces large amounts of heat in a short period of time.

The components chosen to obtain the pyrotechnic mixtures must undergo a suitable mixing process which, depending on the components used, will be in a liquid, solid or pasty medium, for the final mixtures to be obtained without loss of the cohesive properties, such as are required for the purposes of the invention to be as desired.

The use of pyrotechnic mixtures affords a very great variation in the burning speed of the percussion or impact wave conductor unit since, fundamentally, the burning speed will depend exclusively on the pyrotechnic mixture employed and on the homogeneity of the mixture, being almost independent from the amount used per internal tube surface. This latter parameter being of fundamental importance for the maintenance of the percussion or impact wave of the duct, good results have been obtained with charging values of the duct used as a support located between $1\times10^{-2}$ g/cm$^2$ and $4\times10^{-5}$ g/cm$^2$. Any material can be used for the support duct, such as PVC, latex, glass, and others, no problem having been encountered in maintaining the percussion or impact wave. For the internal diameter, excellent results were obtained with ducts from 0.5 mm up to 10 mm in diameter.

The experiments listed ahead are intended to better claify the scope of the invention and must not be construed as limiting the same:

EXAMPLE 1

A mixture was conveniently prepared from a pyrotechnic mixture obtained by mixing together powdered aluminum (d=2.7 g/cm$^3$), potassium bichromate (d=2.69 g/cm$^3$) and ammoniated iron sulfate (d=1.86 g/cm$^3$) in the presence of sufficient ethyl alcohol to obtain two distinct solid-liquid phases. The mixture was prepared at room temperature until about 2% of the solvent remained. The mixture was deposited by being blown onto the interior of two PVC-crystal ducts, one with a 3-mm inner diameter and the other with an 8-mm inner diameter.

Each duct exhibited a surface density of about $2.3\times10^{-4}$ g/cm$^2$, which corresponds respectively to a charge density, per meter of duct, of 21.7 mg/m and 57.8 mg/m. Both ducts having been fired by No. 8 blasting caps, the following burning speeds were recorded: 1000 m/s for the one with the smaller diameter and 1020 m/s for the one with the larger diameter.

EXAMPLE 2

A powdered aluminum and potassium bichromate pyrotechnic mixture was prepared in the same manner as for the previous example, it having been deposited on the interior of a PVC duct with an 8-mm inner diameter, so as to exhibit a charge density of 6 mg/m, which corresponds to only $2.39\times10^{-5}$ g/cm$^2$. The percussion or impact wave conductor unit having been fired, it lacked capability to propagate the percussion wave.

EXAMPLE 3

A potassium bichromate, aluminum and sugar pyrotechnic mixture was prepared in the presence of just enough acetone to produce a thoroughly blended paste which was then caused to dry out.

The pyrotechnic mixture was deposited on the inside of a PVC duct with a 1.5-mm inner diameter, so as to exhibit a duct surface charge of $2.1\times10^{-4}$ g/cm$^2$, which corresponds to 10 mg/m. The percussion or impact wave conductor unit thus comprised was fired with the aid of a No. 8 blasting cap and recorded a burning speed of 1200 m/s.

EXAMPLE 4

The same mixture as prepared in Example 3 was deposited on the inside of another duct with the same diameter, but this time with a charge density of $3.57\times10^{-4}$ g/cm$^2$, which corresponds to 17 mg per linear meter of duct.

The percussion or impact wave conductor unit thus comprised a recorded burning speed of 1180 m/s.

EXAMPLE 5

A pyrotechnic mixture was conveniently prepared, made up by lead oxide, zirconium, vanadium pentoxide, silicon and amorphous boron. This mixture was made to be suited to the purposes of the invention by successive mixing processes in which liquid, pasty and solid mediums were employed in order to obtain the required cohesion. The pyrotechnic mixture thus prepared was carefully deposited on the inside of a high-density polyethylene duct with a 2-mm inner diameter, so as to be secured with a surface charge density of $2.3\times10^{-4}$ g/cm$^2$, which corresponds to 14.4 mg/m. Using latex rubber and the percussion or impact wave conductor unit built as described in Example 3, the two units were joined together so as to produce a new percussion or impact wave conductor unit, now comprised by two different types of pyrotechnic mixtures, two different inner diameters, and two different support ducts.

The new percussion or impact wave conductor unit thus composed recorded a burning speed of 820 m/s in the unit made up by the high-density polythylene support duct, and of 1210 m/s in the percussion or impact wave conductor unit built as per Example 3.

EXAMPLE 6

A percussion or impact wave conductor unit was built by using as a support duct a latex duct with an approximately 1.8-mm inner diameter. As the pyrotechnic mixture to be deposited on the inside, a composition was used containing metallic aluminum, potassium permanganate, lead oxide and sugar, conveniently blended and deposited on the inside of the duct at a surface charge density of $2\times10^{-4}$ g/cm$^2$, which corresponds to a charge of 11.3 mg per meter of duct. A filament of a nickel-chromium alloy with a very low ohmic resistance was coupled to one of the extremities. A voltage of 110 V, provided by a 30-A capacity power source, was applied to the filament. The power source, upon being operated, caused the percussion wave to propagate inside the latex duct, in such a way as to rupture a piece of paper of 80 g/cm$^2$ suitably coupled to the extremity opposite to the one from which the percussion wave was fired.

EXAMPLE 7

A percussion or impact wave conductor unit was built exactly as described in previous Example 6, by cutting it into three sections with approximately one meter in length, the following experiments being performed. The flame of a Bunsen burner was applied to one extremity of the first section and was allowed to slowly spread throughout the entire length of the percussion or impact wave conductor unit, without any sign of firing having been observed in the pyrotechnic composition on the inside of the duct.

The second unit was placed on top of a steel plate and a 2-kilo weight was allowed to drop from a height of four meters on a portion of the percussion or impact wave unit, without anything having been recorded beyond the denting and rupturing of the unit at the points under impact from the weight.

The third and last unit proved to be capable of being fired by a blasting cap with less than 0.1 g of active charge.

EXAMPLE 8

A small amount of the pyrotechnic mixture used for Examples 4 and 5 was placed on a short length of ring-shaped platinum wire, as is commonly used in laboratories for identifying chemical elements by flame tests. When the pyrotechnic mixture was slowly approached by the flame of a Bunsen burner, it was violently set afire with a flash and a relatively high noise, considering the small amount of pyrotechnic material used for the test.

I claim:

1. A non-electric fuse device for initiating explosives comprising:

an elongated hollow duct having entrace and exit ends and an inner annulus having a dimension of from about 0.5 mm to about 10 mm, and containing on the interior surface thereof;

a coating, comprising a pyrotechnic mixture made up of at least three members selected from the group consisting of potassium bichromate, vanadium pentoxide potassium permanganate, sugar, lead oxide, aluminum, silicon and amorphous boron and combination thereof which when present in said coating are bonded to the said inner surface of said hollow duct;

said coating mixture having a coverage of from between about $1\times10^{-2}$ to about $4\times10^{-5}$ gm/cm$^2$ and a burn rate when fired at said entrance end of from between about 500 meters per second to about 1200 meters per second along the interior of said duct whereby explosives placed at said exit end of said duct can be initiated by the products of said pyrotechnic combustion leaving said exit end.

* * * * *